US011311753B2

(12) United States Patent
Kuntze-Fechner et al.

(10) Patent No.: US 11,311,753 B2
(45) Date of Patent: Apr. 26, 2022

(54) CARRYING DEVICE FOR AN AVALANCHE AIRBAG SYSTEM

(71) Applicant: Ortovox Sportartikel GmbH, Taufkirchen (DE)

(72) Inventors: Johannes Kuntze-Fechner, Waakirchen (DE); Christian Bier, Miesbach (DE)

( * ) Notice: Subject to any disclaimer, the term of this patent is extended or adjusted under 35 U.S.C. 154(b) by 0 days.

(21) Appl. No.: 16/964,988

(22) PCT Filed: Jan. 25, 2019

(86) PCT No.: PCT/EP2019/051841
§ 371 (c)(1),
(2) Date: Jul. 26, 2020

(87) PCT Pub. No.: WO2019/145470
PCT Pub. Date: Aug. 1, 2019

(65) Prior Publication Data

US 2021/0046336 A1 Feb. 18, 2021

(30) Foreign Application Priority Data

Jan. 26, 2018 (EP) ..... 18153635

(51) Int. Cl.
*A45F 3/04* (2006.01)
*A62B 33/00* (2006.01)
(Continued)

(52) U.S. Cl.
CPC ..... *A62B 33/00* (2013.01); *A45F 3/04* (2013.01); *A63B 29/02* (2013.01); *A45F 2003/003* (2013.01)

(58) Field of Classification Search
CPC ..... A62B 33/00; B63C 9/08; A41D 13/002; A41D 13/0025; A63B 29/021; A45F 2003/003
(Continued)

(56) References Cited

U.S. PATENT DOCUMENTS 4,787,575 A * 11/1988 Stewart ..... B64B 1/50 116/210
8,876,568 B2 * 11/2014 Blenkarn ..... B63C 9/081 441/80
(Continued)

FOREIGN PATENT DOCUMENTS

| | | | |
|---|---|---|---|
| CH | 711728 | A2 | 5/2017 |
| EP | 2974773 | A1 | 1/2016 |
| WO | 2012035422 | A1 | 3/2012 |

OTHER PUBLICATIONS

European Patent Office, International Search Report for International Application No. PCT/EP2019/051841, dated Mar. 13, 2019.
(Continued)

*Primary Examiner* — Scott T McNurlen
(74) *Attorney, Agent, or Firm* — Bradley Arant Boult Cummings; Timothy L. Capria; Alexandra C. Lynn

(57) ABSTRACT

The invention relates to a carrying device, in particular a backpack (10), for an avalanche airbag system (12), which includes an airbag (14) and a filling device (16) for introducing at least one medium into the airbag (14). The airbag (14) brought into a stowage position is received in a container (18) if the avalanche airbag system (12) is coupled to the carrying device. The container (18) comprises a closure element (34). After opening the closure element (34), the container (18) can be brought from a closed position into an open position. The carrying device includes at least one spring element, which is tensioned if the container (18) is brought into the closed position, and by means of which bringing the container (18) from the closed position into the open position can be effected. The closure element (34) can be opened by actuating an actuating device (28), by means of which the filling device (16) can be brought into a triggered state. In the triggered state, the filling device (16) introduces the at least one medium into the airbag (14).

20 Claims, 6 Drawing Sheets

Figure 1:
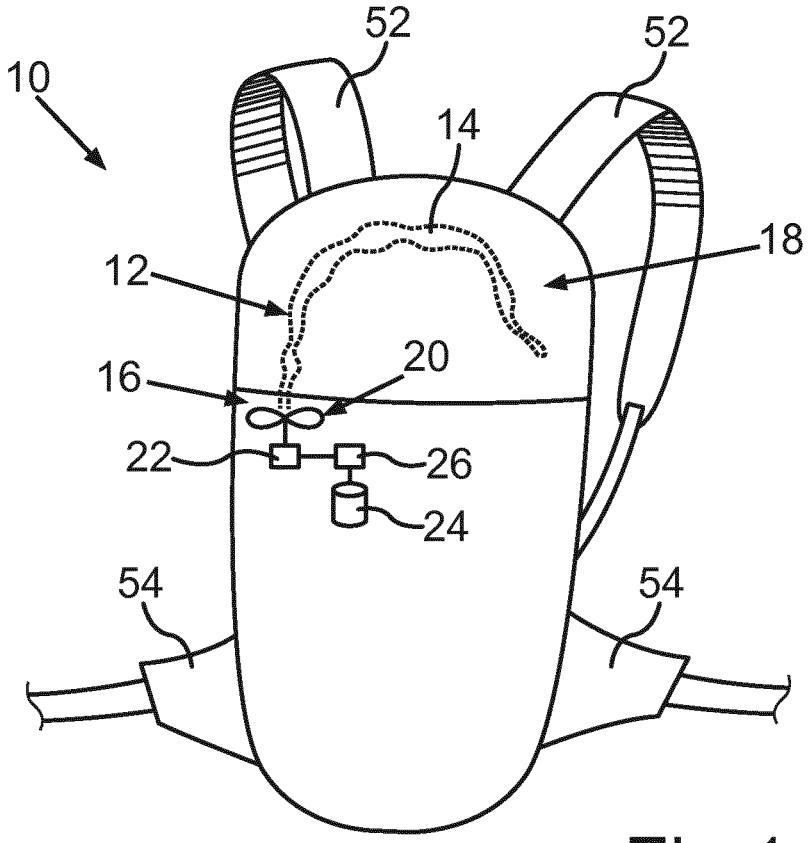

(51) Int. Cl.
*A63B 29/02* (2006.01)
*A45F 3/00* (2006.01)

(58) Field of Classification Search
USPC ..... 116/210; 441/80, 114; 2/DIG. 3
See application file for complete search history.

(56) References Cited

U.S. PATENT DOCUMENTS

| | | | | |
|---|---|---|---|---|
| 9,427,625 | B2 * | 8/2016 | Rose | B63C 9/155 |
| 9,687,063 | B2 * | 6/2017 | Paduano | A45F 3/08 |
| 11,034,419 | B2 * | 6/2021 | Kuder | A63B 29/02 |
| 2008/0282453 | A1 * | 11/2008 | Alstin | A41D 13/0512 2/413 |
| 2017/0216680 | A1 | 8/2017 | Neubauer et al. | |
| 2018/0326233 | A1 * | 11/2018 | Staub | A62B 99/00 |

OTHER PUBLICATIONS

European Patent Office, Written Opinion of the International Searching Authority for International Application No. PCT/EP2019/051841, dated Mar. 13, 2019.

* cited by examiner

CARRYING DEVICE FOR AN AVALANCHE AIRBAG SYSTEM

The invention relates to a carrying device for an avalanche airbag system including an airbag and a filling device for introducing at least one medium into the airbag. The airbag brought into a stowage position is received in a container of the carrying device if the avalanche airbag system is coupled to the carrying device. The container comprises at least one closure element. After opening the closure element, the container can be brought from a closed position into an open position.

Such carrying devices in the form of backpacks equipped with the avalanche airbag system are commercially available. For example, there are avalanche airbag backpacks, in which a container in the form of an airbag pocket tears if a pressure present in the airbag pocket, which is caused by inflating the airbag arranged in the airbag pocket, exceeds a certain value. Namely, a zipper then yields, which usually keeps the airbag pocket closed.

The airbag pocket is mostly a chamber or such a container which is separated from a further stowage compartment of the backpack, and in which the airbag is stored protected from damage. In addition, the airbag pocket ensures that the airbag does not fall out of the backpack during the normal use. At the same time, the airbag should be packed as tightly as possible in order that valuable backpack volume is not unnecessarily taken by the airbag. This purpose too is ensured by the airbag pocket or the container, in which the airbag brought into its stowage position is received.

However, if the avalanche airbag system is triggered, thus, this causes opening the airbag pocket as a result of inflation of the airbag such that the then released airbag can be further filled.

For filling the airbag of an avalanche airbag system, compressed gas from a cartridge can be used on the one hand. In such an avalanche airbag system, a Venturi device is often additionally used. Herein, the gas coming from the cartridge, flowing through the Venturi device results in ambient air being additionally sucked in. In such an avalanche airbag system, the airbag is then filled both with the gas from the cartridge and with ambient air.

Furthermore, WO 2012/035422 A1 describes a backpack with an avalanche airbag system, in which the airbag is filled by operating a blower, wherein the blower obtains energy from an electrical energy source. Here too, the inflation of the airbag causes the airbag to be transported out of an airbag pocket of the backpack.

In the avalanche airbag system of WO 2012/035422 A1, the circumstance is to be regarded as disadvantageous that a considerable part of the energy available for inflating the airbag is already used to open the airbag pocket and to bring the airbag out of the airbag pocket by the inflation. Only after the airbag pocket is opened and once the airbag tightly folded in its stowage position is deployed, ambient air (or gas from the cartridge) can freely or largely unimpeded further flow into the airbag.

In an avalanche airbag system, in which the compressed gas from the cartridge is used for filling the airbag, the output of the airbag from the airbag pocket does not present a particular challenge with regard to the pressure to be procured hereto, since the pressure present at the beginning of the deploying operation can be at up to 300 bar. However, this very high pressure of the compressed gas in the cartridge can result in uncontrolled rupture of the airbag pocket occurring, in particular if the opening mechanism is erroneously constructed or damaged. However, a part of the pressure of the compressed gas is also used for outputting the airbag from the airbag pocket even in using the avalanche airbag system including the cartridge. This is inefficient on the one hand, and on the other hand a valuable gain in time could be achieved if the cartridge would not have to provide the pressure required for forcing the airbag pocket open.

However, in particular in an avalanche airbag system, in which the airbag is filled by means of an electrically driven blower, particularly much energy is lost for opening the airbag pocket and for outputting the airbag from the airbag pocket. This is because the pressure, that a usual blower procures, is at about 30 mbar to 60 mbar. This value is lower by the factor of 10,000 to 5,000 than in an avalanche airbag system, in which a cartridge with pressurized gas is employed.

In order to provide a higher pressure, manufacturers of avalanche airbag systems for example use a blower formed as a side channel compressor. With such a blower, a slightly higher pressure of up to about 100 mbar can be provided and used for opening the airbag pocket as well as for outputting the airbag from the airbag pocket. However, in such an avalanche airbag system, it is disadvantageous that the blower can only deliver a lower volume flow than a blower, which procures a lower pressure or dynamic pressure. Namely, the electric motor of an electrically operated blower has a characteristic line, which indicates, at which dynamic pressure which volume flow can be delivered. A high dynamic pressure means a lower volume flow at the same time and vice versa. With a blower designed for a high pressure, thus for instance with the side channel compressor, filling the airbag after output thereof from the airbag pocket thus takes longer than it is the case with a blower, which is designed for a high volume flow.

Independently of the type of the used blower, however, the portion of the energy is considerable, which has to be spent for opening the airbag pocket and for outputting the airbag in such an electrical avalanche airbag system. Accordingly, an electrical energy storage is usually comparatively largely dimensioned and a comparatively large blower is also partially used in an avalanche airbag system with an electrically operated filling device, which is designed for compression and thus can provide a high dynamic pressure, and nevertheless delivers a higher volume flow than a smaller blower, which can provide the same dynamic pressure.

Both measures result in the fact that the avalanche airbag system is comparatively heavy, bulky and also expensive.

Therefore, it is the object of the present invention to provide an improved carrying device of the initially mentioned type.

This object is solved by a carrying device having the features of claim 1. Advantageous configurations with convenient developments of the invention are specified in the dependent claims.

The carrying device according to the invention, which can in particular be formed as a backpack, is provided for an avalanche airbag system, which includes at least one airbag and a filling device for introducing at least one medium into the at least one airbag. The carrying device includes at least one container, in which the at least one airbag brought into a stowage position is received if the avalanche airbag system is coupled to the carrying device. The container comprises at least one closure element. After opening the at least one closure element, the container can be brought from a closed position into an open position. The carrying device includes at least one spring element, which is tensioned if the container is brought into the closed position. By means of the at least one spring element, bringing the container from the closed position into the open position can be effected. The at least one closure element can be opened by actuating an actuating device, by means of which the filling device of the avalanche airbag system can be brought into a triggered state. In the triggered state, the filling device introduces the at least one medium into the airbag.

Thus, the closure element is configured such that it can be opened by actuating the actuating device. With opened closure element, the at least one spring element can in turn effect bringing the container from the closed position into the open position. Thus, the at least one spring element forces the container open. By this mechanic opening of the container, which can in particular be formed as a so-called airbag pocket of the carrying device or the backpack, energy for opening the container does not have to be provided by the avalanche airbag system. Both with configuration of the carrying device for an avalanche airbag system including a cartridge with compressed gas, and for an avalanche airbag system comprising an electrically operated filling device, this is advantageous and the carrying device is correspondingly improved.

This is because at least the opening of the container, thus bringing the container from the closed position into the open position, can be realized independently of the energy reserves of an electrical energy storage of the avalanche airbag system with electrically operated filling device and independently of the pressure provided by the cartridge, respectively.

This is based on the finding that if the container is opened and the airbag of the avalanche airbag system is already ejected from the container, at least 10 percent of the energy can be saved, which is required for inflating or filling the airbag if opening the container and outputting the airbag from the container are effected by inflating the airbag. Thus, opening the airbag pocket and outputting the airbag from the airbag pocket draws significant energy.

If gas from a cartridge is used for filling the airbag, thus, the pressure of the cartridge can be significantly lower than usual in current avalanche airbag systems and for example be at only 100 bar. This is for example advantageous to the effect that there are restrictions with respect to the transport of cartridges filled with gas in airplanes, in which the pressure of the gas stored in the cartridge plays a role.

If the carrying device is configured for an avalanche airbag system with an electrically operated filling device, thus, providing the at least one spring element is of particularly great advantage. Because less electrical energy then has to be provided by an electrical energy storage of the avalanche airbag system since the container does not also have to be opened by means of the electrically operated blower of the avalanche airbag system. Thereby, the avalanche airbag system can be configured particularly small and particularly lightweight.

This is in particular true since avalanche airbag systems have to reliably trigger even at very low temperatures of down to −30 degrees Celsius. However, at very low temperatures, the performance of electrical energy storages in the form of for example accumulators greatly decreases compared to the performance at higher temperatures. In order to compensate for this too, the electrical energy storages of avalanche airbag systems with an electrically operated filling device are usually correspondingly largely configured.

In this respect too, it is thus advantageous if the at least one spring element effects opening the container at the same time with the actuation or due to actuation of the actuating device. Because a mechanic energy storage in the form of the at least one spring element ensures that energy required for bringing the container from the closed position into the open position is available even at very low temperatures without problem. Thereby, more energy from the electrical energy storage of an avalanche airbag system with electrical filling device can be used for filling the airbag. This increases the safety of the avalanche airbag system.

Since bringing the container from the closed position into the open position functions independently of filling the airbag by introducing the at least one medium into the airbag, a particularly fast and reliable filling of the airbag can be achieved. Because by the fast and in particular complete opening of the container or the airbag pocket, it can be achieved that the airbag can be fast filled with particularly low primary pressure.

For example, the at least one spring element can be formed of a spring steel, which is pre-tensioned in packing the airbag or in forcing the airbag into the container. In analogous manner, however, a spring element formed of a carbon material and/or a spring element formed of a fiber-reinforced plastic, in particular a glass fiber-reinforced plastic, for instance in the form of a rod or the like can also effect bringing the container from the closed position into the open position if the closure element is opened. The at least one spring element can also be formed as a coil spring, the tension of which can effect opening the container.

The pre-tension of the at least one spring element serving for mechanically opening can in particular be generated in packing the airbag, thus in introducing the airbag into a receiving space of the container.

The container can include a base body and a lid element, wherein tensioning the at least one spring element can for example be effected by closing the lid element. In such a configuration of the container, bringing the same into the open position by means of the at least one spring element can be particularly reliably and functionally securely effected.

The base body and/or the lid element are preferably formed inherently rigid, for example by forming the base body and the lid element, respectively, of a plastic such that the container is formed in the manner of a hard-shelled box. This makes it particularly simple to provide at least one spring element for example formed as a leg spring at the container for opening the container. For example, two spring elements in particular formed as leg springs can be attached in an area of the base body, in which the lid element is hinged to the base body, in the manner of hinges. In this manner, a carrying device with a particularly robust and functionally secure opening device is provided.

Additionally or alternatively, the at least one spring element can include a first bracket and a second bracket, which bound an outlet opening of the container if the container is brought into the open position. Herein, two partial areas of the container connected to each other, at which a respective bracket is arranged, can be formed in particular of a flexible material, for example of a foil-like plastic material and/or of a textile material. Thereby, the container takes up particularly little volume if no airbag is received in the container.

In addition, by a flexible wall material of the container, which is tensioned in bringing the container into the open position, ejection of the airbag from the receiving space of the container can at least be supported. Because areas of the brackets, which are close to each other in the closed position of the container, are moved farther away from each other in the open position of the container. This preferably effects tensioning of the wall material formed as a flexible planar formation. Tensioning the wall material in turn preferably effects ejection of the airbag from the receiving space of the container. Herein, the planar formation can be formed in the manner of at least one textile of fibers and/or in the manner of at least one foil of a polymer material or plastic material.

In addition, if the at least one spring element includes the first bracket and the second bracket, another closure means such as for instance a zipper or a Velcro fastener can be omitted to close the outlet opening of the container in the closed position of the container.

Furthermore, only the at least one closure element has to be provided, which is to be opened, to subsequently effect bringing the container into the open position by means of the brackets. This makes the construction of the container particularly simple. If the brackets of the spring elements are moved towards each other, in particular abut on each other, the spring element is pre-tensioned and the spring element can effect bringing the container into the open position. Hereto, only the actuating device first has to be actuated to open the at least one closure element.

Preferably, the at least one spring element is formed to transport the airbag out of a receiving space of the container, which is formed for receiving the airbag brought into its stowage position. Namely, if the at least one spring element does not only open the container or the airbag pocket, but additionally outputs the airbag, thus, filling the airbag can be particularly fast and even simpler realized.

For example, a substantially rod-shaped spring element and/or a coil spring can effect the output of the airbag from the receiving space of the container.

It has proven particularly advantageous if the at least one spring element is curved in the tensioned state such that the at least one spring element encloses the receiving space. Herein, free ends of the at least one spring element in the relaxed state thereof are farther spaced from each other than in the tensioned state. By such stretching of the at least one spring element, both opening the container and outputting the airbag from the container can be particularly simply and reliably effected.

Herein, the at least one spring element does not have to completely enclose the receiving space, but the spring element can have a U-shaped or circular arc-shaped configuration in the curved state, in which the free ends of the spring elements are still spaced from each other even in the tensioned state. The spring element can be brought into the curved, tensioned state by forcing the airbag into the receiving space of the container.

Preferably, a plurality of spring elements curved in the tensioned state is arranged in the container. Because the container can then be very well opened on the one hand and the airbag can be particularly functionally securely output out of the container on the other hand. For example, three, five or also more spring elements can enclose the receiving space at least in certain areas in the tensioned, curved state, which are distributed over the length of the receiving space and in particular uniformly spaced from each other.

Preferably, a first one of the spring elements curved in the tensioned state is retained in the tensioned state by the at least one closure element. Herein, at least one further spring element of these spring elements is retained in the tensioned state due to the closed position of the container. In other words, only the first spring element is locked by the closure element and the remaining spring elements, thus the further spring elements, are only kept under pre-tension by the container brought into its closed position. This has the advantage that the first spring element only has to be unlocked by detaching or opening the closure element. The further spring elements then ensure complete opening of the container thereafter, but nearly at the same time with the first spring element. Thereby, bringing the container into the open position can be particularly fast and functionally securely realized.

Preferably, the carrying device comprises at least two further spring elements curved in the tensioned state. Thus, very uniform and at the same time fast opening of the container can be effected. This in particular applies if the at least two further spring elements are substantially equally far spaced from the first spring element. However, for example four or also more further spring elements can also be provided, wherein respective pairs of spring elements are then preferably equally far spaced from the first spring element.

Preferably, the at least one closure element includes a hook, which is movable from an engagement position into a release position by actuating the actuating device.

This is based on the finding that a Velcro fastener is employed in commercial avalanche airbag backpacks as the closure element of an airbag pocket or a container, in which the airbag can be stowed. However, it is disadvantageous in the Velcro fastener that the retaining force of such a closure element greatly varies depending on how well the Velcro fastener is pressed on, if the Velcro fastener is wet or for example full of snow and which temperature prevails.

Therefore, in using a Velcro fastener as the closure element, it can occur that the airbag pocket tears already in normal use or that the airbag pocket does not open along a predetermined breaking point for instance in the form of a tear zipper (burst-zip) as intended, but tears in uncontrolled manner. This in turn can result in the fact that the airbag cannot deploy at all, cannot well deploy or only partially deploy. This is disadvantageous and a safety risk, respectively, with regard to the function of the avalanche airbag system of providing protection for the wearer of the carrying device or the backpack by the inflated airbag.

In contrast, if the hook is employed as the at least one closure element, thus, the closure element can be particularly reliably detached or opened by actuating the actuating device. For example, the hook coupled to the actuating device can be pulled into the release position by actuating the actuating device such that the at least one spring element is then unlocked. This then in turn means that the container is brought from the closed position into the open position by the spring element.

Additionally or alternatively, the at least one closure element can include a magnet. In particular a magnet, which is shifted parallel and/or perpendicular to the force retaining the magnet in its closure position, can be particularly simply moved from the locking position into the release position, in which the closure element is opened. In addition, locking the closure element can be particularly simply accomplished by using a closure element including the magnet.

In particular if the avalanche airbag system includes an electrically operated filling device, an electrically operable closure element for instance in the form of an electrically operable latch, in the form of an electromagnet or the like can also be provided.

Preferably, the airbag is arranged in the container, wherein the at least one spring element is connected to a wall material of the airbag. For example, the at least one spring element can be stitched into the wall material of the airbag or stitched onto the wall material. Additionally or alternatively, a material strip can be firmly bonded, in particular welded, to the wall material of the airbag and form a pocket, into which the spring element is introduced. In this manner, the at least one spring element can support the deployment of the airbag or give a certain structure to the airbag if the spring element is brought into its relaxed state. Accordingly, filling the airbag with the at least one medium is facilitated.

In the closed position of the container, a closure means is preferably secured by means of the closure element, which closes an outlet opening of the container in the closed position. Preferably, such a closure means is formed as a tear zipper (burst-zip), which can be very easily opened as soon as a retaining force is released on at least one tear point of the zipper. Namely, such a tear zipper does not tear in undefined manner, but only from the at least one tear point. Furthermore, the closure means can be formed as a Velcro fastener or the like.

By such a closure means, in particular upon providing multiple spring elements, it can be ensured that at least one of these spring elements is retained in the tensioned state in that the closure means closes the outlet opening of the container in the closed position of the container.

Preferably, the avalanche airbag system is coupled to the carrying device, wherein the filling device includes a blower with an electric motor and at least one electrical energy storage for supplying the electric motor with electrical energy. For coupling or connecting the avalanche airbag system to the carrying device, corresponding fixing means can be provided in the container, for instance in the form of clips, Velcro fasteners, hooks with rotatable clasps, which are passed through eyelets, and the like. This allows equipping the carrying device in particular configured as a backpack with the avalanche airbag system according to need. On the other hand, the carrying device can also be used without the avalanche airbag system, wherein additional stowage space is then available by the container.

In particular if the avalanche airbag system includes the electrically operated filling device, in which the blower with the electric motor is provided, the mechanic opening and preferably also the output of the airbag of the avalanche airbag system out of the container is particularly advantageous. Because in that the opening of the airbag pocket or the container and preferably also the output of the airbag from the receiving space of the container is independent of the electrical energy supply of the electric motor, the at least one electrical energy storage can be particularly small dimensioned. Namely, electrical energy does not have to be provided for opening the container and for outputting the airbag, respectively. Rather, the energy is provided by the at least one spring element.

Furthermore, the blower can then be configured such that it provides a large volume flow and does not have to procure a very high dynamic pressure. Thus, the filling time required for filling the airbag can be kept particularly short. This in turn results in the fact that the at least one electrical energy storage also has to provide electrical energy for the electric motor only over a shorter period of time. This too contributes to the fact that an electrical energy storage with a comparatively low nominal capacity is sufficient to provide the electric motor of the blower with electrical energy.

Therefore, the blower is preferably formed as an axial compressor since such a blower is designed for a high volume flow. By means of such a blower, the airbag can for example be filled within about three seconds of the filling procedure such that it contains a certain volume, for example a volume of about 150 liters, of ambient air. Subsequently, by actuating the blower over about three further seconds, the pressure in the airbag inflated to its maximum volume can be increased. If a comparatively high pressure is to be set herein, thus, the blower can for example also be formed as a radial compressor. After inflating or filling the airbag, the volume or the pressure in the airbag can be maintained by closing at least one valve.

Furthermore, it is preferably provided that the blower, which can in particular be arranged outside of the container, remains in the carrying device or the backpack and is not ejected like the airbag. This is also associated with the fact that energy required for outputting can be saved.

Preferably, the actuating device includes a handle, wherein starting the electric motor can be effected by pulling the handle. By pulling the handle, thus, the filling device is brought into the triggered state on the one hand, in which the filling device introduces ambient air into the airbag. On the other hand, pulling the handle at the same time effects that the at least one closure element is opened and thus the at least one spring element moves the container from the closed position into the open position.

The features and feature combinations mentioned above in the description as well as the features and feature combinations mentioned below in the description of figures and/or shown in the figures alone are usable not only in the respectively specified combination, but also in other combinations or alone without departing from the scope of the invention. Thus, implementations are also to be considered as encompassed and disclosed by the invention, which are not explicitly shown in the figures and explained, but arise from and can be generated by separated feature combinations from the explained implementations. Thus, implementations and feature combinations are also to be considered as disclosed, which thus do not comprise all of the features of an originally formulated independent claim. Moreover, implementations and feature combinations are to be considered as disclosed, in particular by the implementations set out above, which extend beyond or deviate from the feature combinations set out in the back-references of the claims.

Figure 2:
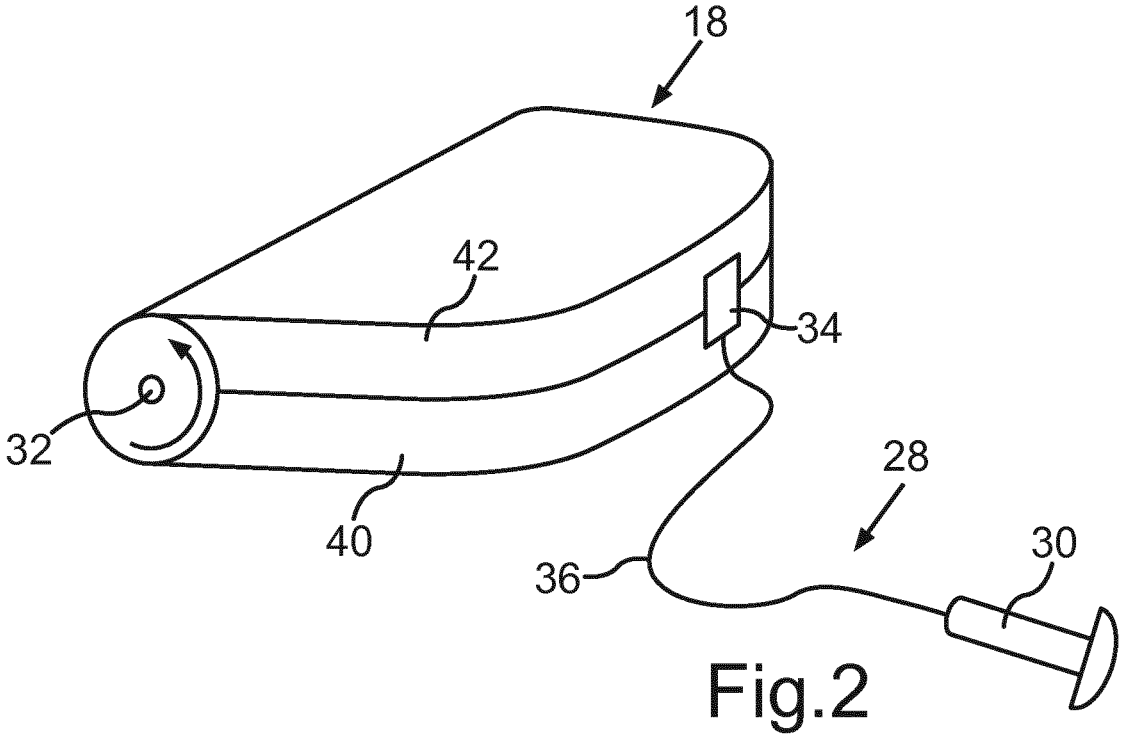
Figure 3:
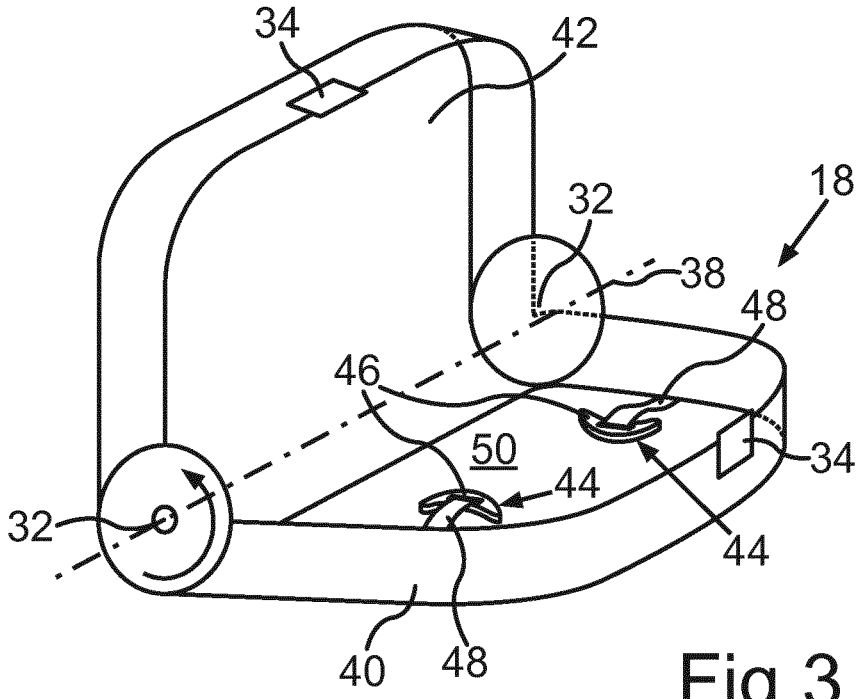
Figure 4:
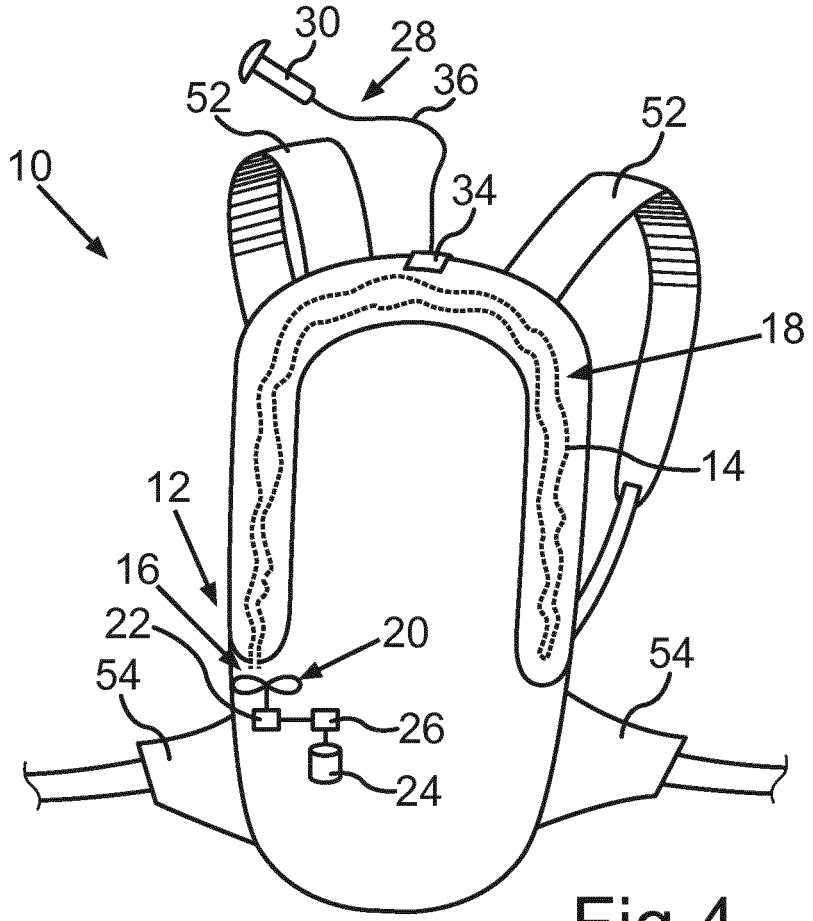
Figure 5:
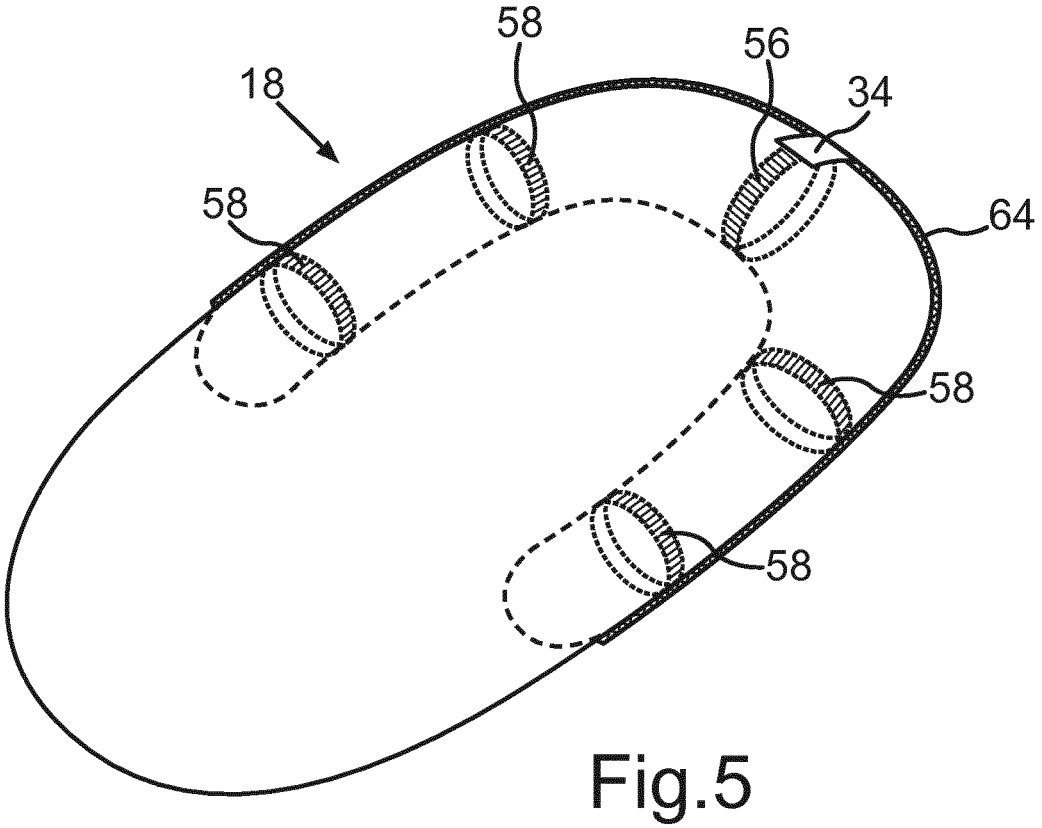
Figure 6:
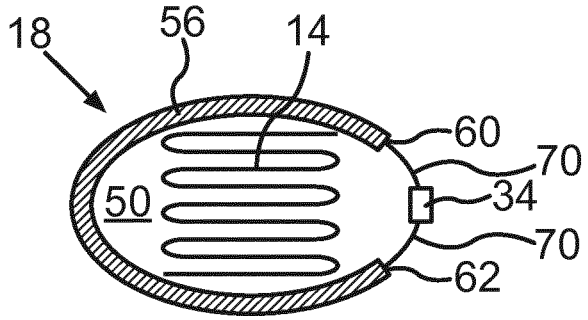
Figure 7:
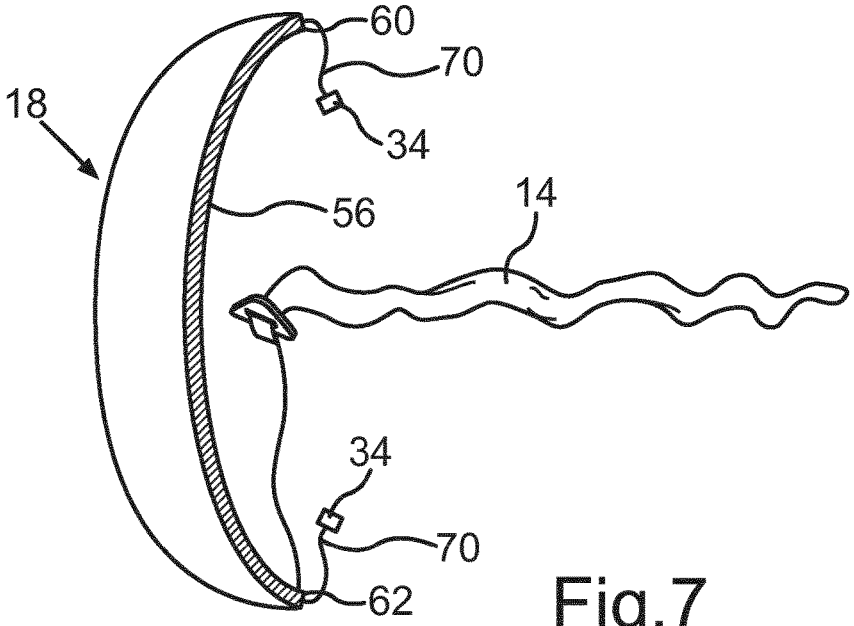
Figure 8:
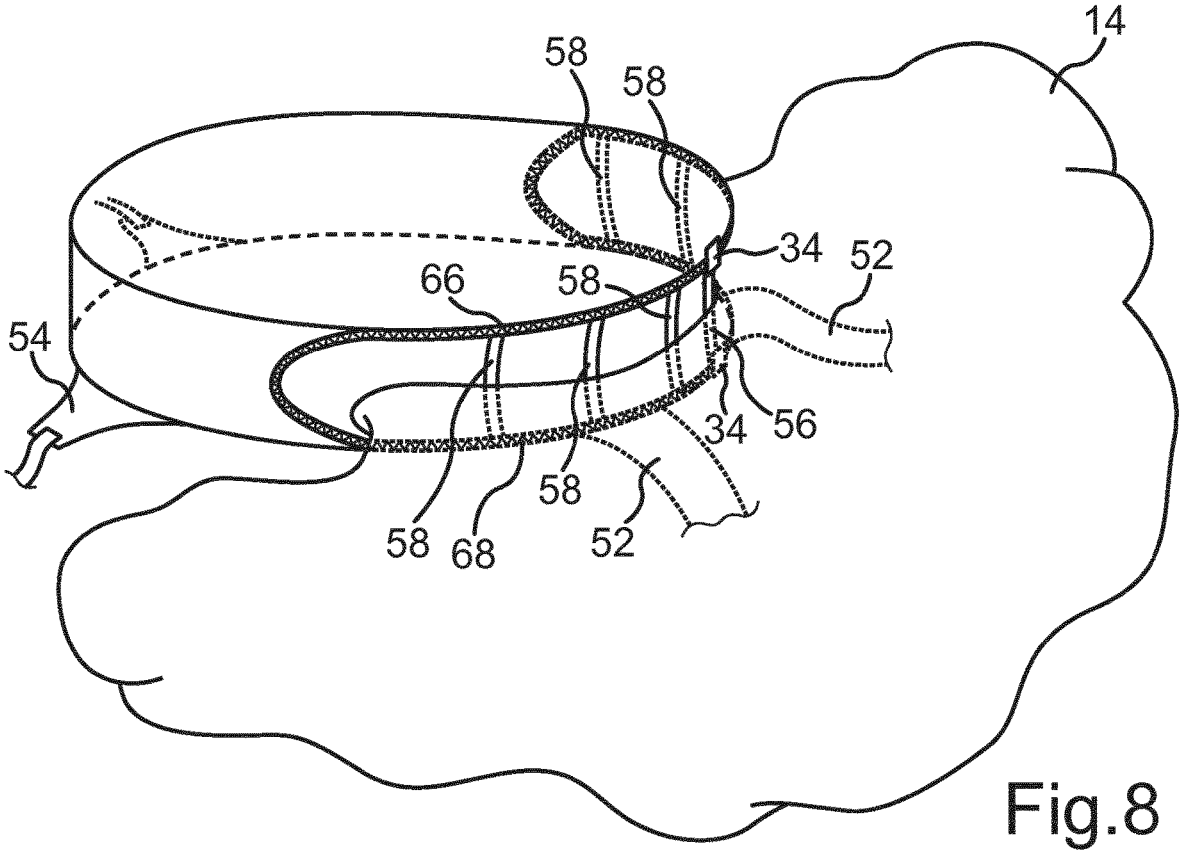
Figure 9:
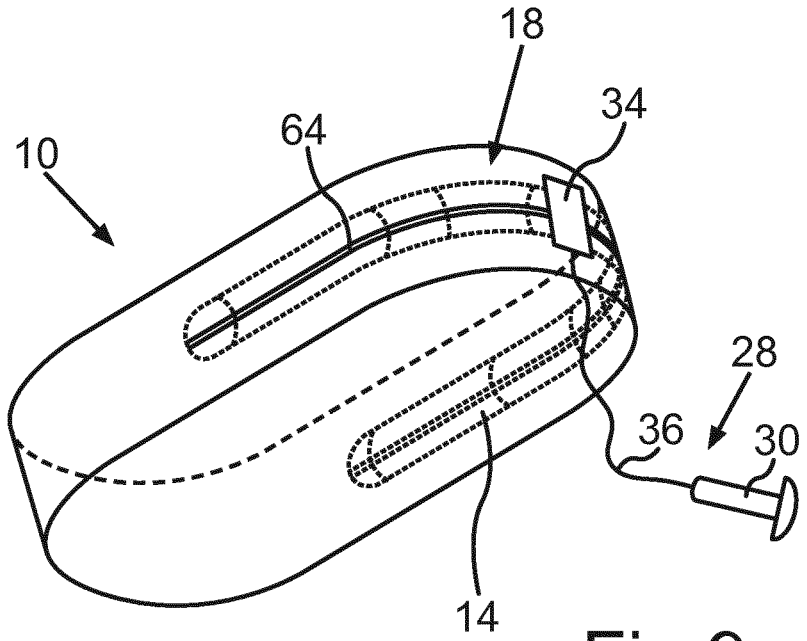
Figure 10:
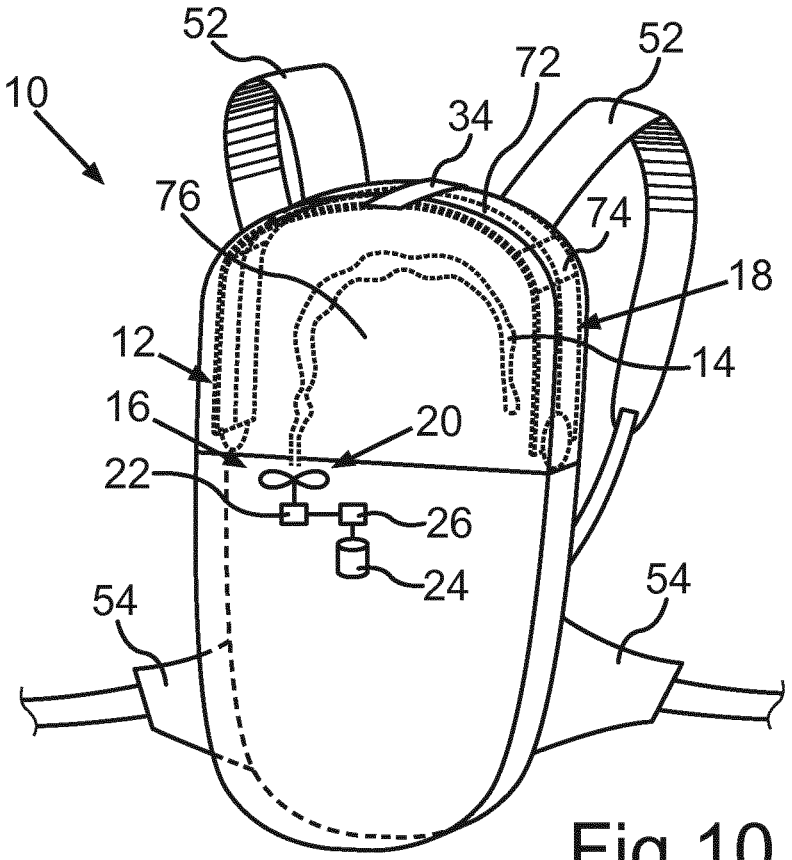
Figure 11:
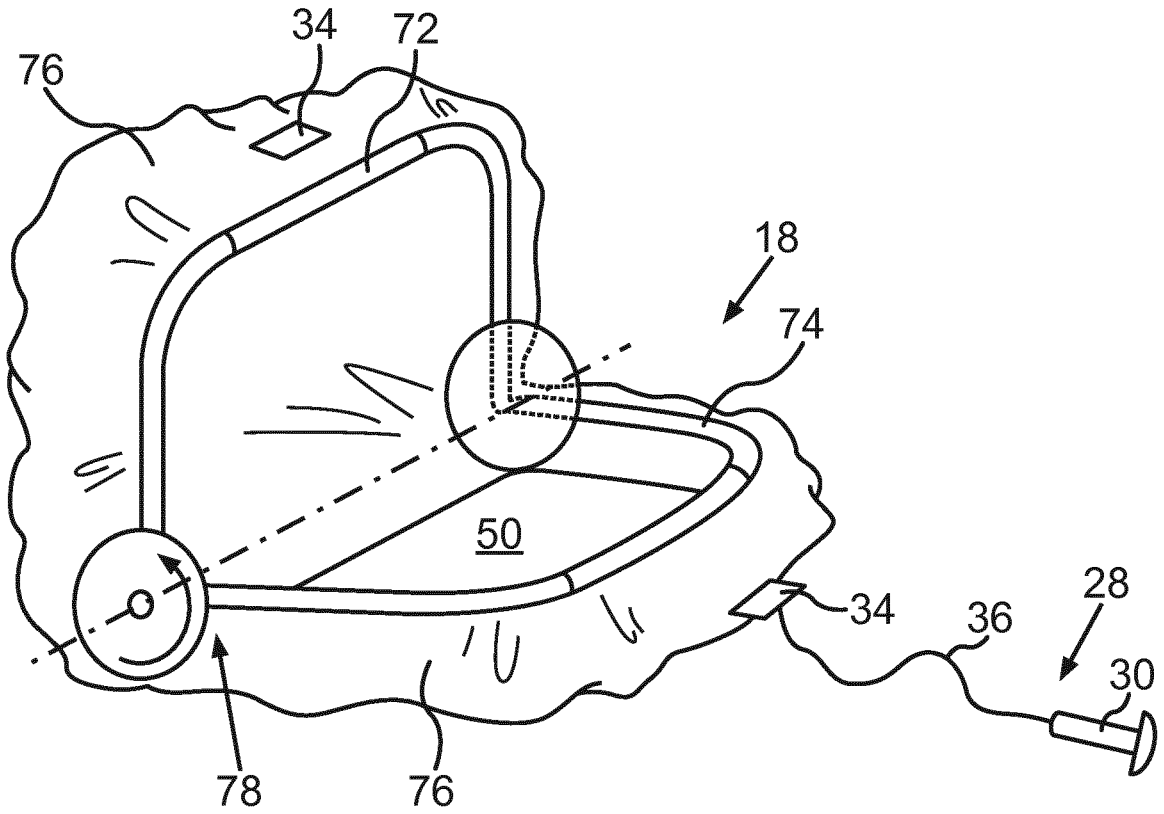

Further advantages, features and details of the invention are apparent from the claims, the following description of preferred embodiments as well as based on the drawings, in which functionally identical elements are provided with identical reference characters. These show in:

FIG. 1 schematically an avalanche airbag backpack, in which an airbag pocket of the backpack formed as a hard-shelled box is closed;

FIG. 2 schematically the closed airbag pocket according to FIG. 1 in a perspective view;

FIG. 3 the airbag pocket according to FIG. 2 in an open position;

FIG. 4 a variant of the avalanche airbag backpack, in which the airbag pocket is U-shaped formed;

FIG. 5 the airbag pocket of the airbag backpack according to FIG. 4, wherein spring elements arranged in the airbag pocket are shown in a tensioned state;

FIG. 6 one of the spring elements according to FIG. 5 in a sectional view of the airbag pocket;

FIG. 7 opening the airbag pocket according to FIG. 4 by means of the spring elements, wherein an airbag received in the airbag pocket is output at the same time;

FIG. 8 the backpack according to FIG. 4 with opened airbag pocket and output airbag;

FIG. 9 a further perspective view of the backpack according to FIG. 4, wherein the airbag pocket is closed;

FIG. 10 a variant of the avalanche airbag backpack, wherein the airbag pocket comprises a spring element with two brackets, which are retained in a tensioned state by a closure or a lock; and FIG. 11 the airbag pocket of the backpack according to FIG. 10, wherein the brackets have forced open the airbag pocket after opening the closure.

FIG. 1 schematically shows a carrying device in the form of a backpack 10, which is formed as an avalanche airbag backpack. Accordingly, the backpack 10 is equipped with an avalanche airbag system 12, which includes an airbag 14 and a filling device 16 for filling or inflating the airbag 14. In FIG. 1, the airbag 14 is shown greatly schematized brought into a stowage position, in which the airbag 14 is folded.

In order to be able to stow the airbag 14 separated from other content of the backpack 10 and as space saving as possible, the airbag 14 is accommodated in a container 18, which serves for storing the airbag 14 and thus can also be referred to as an airbag pocket. The airbag 14 is well protected from wetness, from mechanical effects, from UV radiation and the like in the container 18 or the airbag pocket. In addition, the container 18 or such an airbag pocket ensures that the airbag 14 is always arranged correctly positioned in the backpack 10 for reliable deployment.

Presently, the filling device 16 includes a blower 20 with an electric motor 22 as well as at least one electrical energy storage 24 for supplying the electric motor 22 with electrical energy. The electrical energy storage 24 can in particular be provided by at least one battery and/or at least one accumulator and/or at least one capacitor. A control unit 26 of the filling device 16 controls the electric motor 22 when the filling device 16 is triggered. Thereupon, the blower 20 blows sucked in ambient air into the airbag 14 until the airbag 14 is filled and has a predetermined pressure. For triggering the filling device 16, an actuating device 28 is actuated, which includes a handle 30 (compare FIG. 2 and FIG. 4). By pulling the handle 30, thus, starting the electric motor 22 is effected.

The container 18 or the airbag pocket is configured such that it does not accidentally open in normal use of the backpack 10. Furthermore, it is desirable if the container 18 opposes as little resistance as possible to the filling airbag 14 upon triggering the avalanche airbag system 12 since this costs energy and valuable time.

Therefore, the circumstance is in particular presently accommodated that a considerable part of the energy reserves provided by the electrical energy storage 24 usually has to be provided by the blower 20 to open the airbag pocket or the container 18 and to output the airbag 14 from the container 18. However, the energy required hereto presently does not have to be provided by the blower 20.

This is because the container 18, which is shown without the backpack 10 in FIG. 2, comprises spring elements for instance in the form of two leg springs 32, which are only schematically indicated in FIG. 2 and FIG. 3. If the container 18, as shown in FIG. 2, is closed or brought into a closed position, thus, the leg springs 32 are tensioned. However, a closure element 34 ensures that the leg springs 32 do not unintentionally open the container 18. The closure element 34 is also only schematically shown in FIG. 2 and FIG. 3.

Presently, the closure element 34 is coupled to an element of the actuating device 28 for example formed as a pull rope 36. Accordingly, the closure element 34 comprises a device, which allows coupling to the actuating device 28, in particular to the pull rope 36. Such a device can be provided for instance in the form of a mount or receptacle for the pull rope 36.

By pulling the handle 30 of the actuating device 28, the pull rope 36 thus pulls the closure element 34, such that the closure element 34 is opened. Hereto, the closure element 34 can for example be formed as a mechanically lockable hook or the like. By pulling the handle 30, the hook is then moved from a locking position or engagement position (compare FIG. 2) into a release position (compare FIG. 3) via the pull rope 36. This results in the leg springs 32 being transferred from the tensioned state (compare FIG. 2) into a relaxed state (compare FIG. 3) as the leg springs 32 force the container 18 open. Thus, the blower 20 does not have to provide the force required for opening the container 18. In closing the container 18, the leg springs 32 or the like spring elements or mechanical energy storages are again tensioned and locking or closing the closure element 34 ensures that the container 18 nevertheless remains in its closed position shown in FIG. 2.

In the variant of the backpack 10 shown in FIG. 1 to FIG. 3, the container 18 includes two inherently rigid housing parts pivotable around a pivot axis 38 relative to each other in the form of a base body 40 and a lid element or lid 42. Accordingly, the container 18 is configured as a hard-shelled box in the backpack 10 according to FIG. 1, in which the spring elements for instance in the form of the leg springs 32 open the lid 42 and thus can bring the container 18 into its open position shown in FIG. 3. The base body 40 and the lid 42 can be formed in the manner of half shells, which substantially have an identical configuration.

Presently, fixing elements 44 arranged in the container 18 are schematically shown in FIG. 3, which serve for fixing the airbag 14 in a receiving space 50 of the container 18. Presently, the fixing elements 44 include buttons 46 or clasps formed in the manner of crescents, which are fixed to the container 18 via belts 48 and can be threaded into corresponding eyelets or slits, which are provided in belts on sides of the airbag 14.

Upon unlocking the closure element 34 by pulling the handle 30, the container 18 under spring tension opens very fast. In addition, the construction is preferably configured such that the airbag 14 is also actively transported out of the container 18 or out of the receiving space 50. Hereto, additional spring elements or elastic elements for instance in the form of spring steel rods, rods of carbon material and/or fiber-reinforced plastics, spiral springs, coil springs or the like can be provided. However, such spring elements can also effect opening the container 18 like the presently exemplarily described leg springs 32.

FIG. 4 shows a variant of the backpack 10, in which the airbag pocket or the container 18 is substantially U-shaped formed, wherein respective legs of the U-shape face downwards and extend along sides of the backpack 10. In the backpack 10 shown in FIG. 4 too, shoulder straps 52 as well as waist straps 54 are indicated as in FIG. 1.

The filling device 16 of the avalanche airbag system 12 includes the blower 20 with the electric motor 22, the control unit 26 and the electrical energy storage 24 also in the backpack 10 shown in FIG. 4. In addition, the airbag 14 brought into its stowage position is indicated, which is arranged folded in the receiving space 50 of the container 18 (compare FIG. 6). In the airbag pocket shown in FIG. 4 and FIG. 5 or the container 18 for receiving the airbag 14 too, spring elements for bringing the container 18 into the open position are provided and integrated in the container 18, respectively.

In the container 18 according to FIG. 4 and FIG. 5, multiple spring elements for opening the container 18 are preferably provided. For example, leaf springs 56, 58 are employed as such spring elements, which are shown in their curved, tensioned state in FIG. 5 and in FIG. 6. These leaf springs 56, 58 are preferably pressed into the container 18 or the airbag pocket in packing the airbag 14 and herein brought into the curved shape shown in FIG. 5 and FIG. 6. In this tensioned state, the leaf springs 56, 58 enclose the receiving space 50 in circumferential direction such that free ends 60, 62 of the respective leaf springs 56, 58 (compare FIG. 6) are only a little bit spaced from each other.

At the first spring element, namely at the leaf spring 56, the container 18 is closed or locked by means of the closure element 34. If this closure element 34 is unlocked by pulling the handle 30 or thereby by the pull rope 36 (compare FIG. 4), thus, this first leaf spring 56 moves into the relaxed state shown in FIG. 7, in which the free ends 60, 62 are farther spaced from each other.

As the closure means for closing the airbag pocket shown in FIG. 5 or the container 18, a closure means presently formed as a zipper 64 which is preferably formed as a tear zipper is provided in addition to the closure element 34. Tooth rows 66, 68 of the zipper 64 opposing each other (compare FIG. 8) can be easily separated from each other if the zipper 64 is detached at the tear point or rupture point. This tear point is presently arranged at the closure element 34 and thus substantially in central manner related to the U-shape of the container 18 or the airbag pocket. The tooth rows 66, 68 of the zipper 64 can then be separated from this tear point. This results in the fact that the remaining leaf springs 58 can also be transferred into their relaxed or stretched state in unimpeded manner, which is shown in FIG. 8. Upon triggering the airbag 14 by pulling the handle 30 (compare FIG. 4), thus, the first spring element or the first leaf spring 56 is unlocked, the remaining spring elements or leaf springs 58 then automatically follow.

The further spring elements or leaf springs 58 curved in the tensioned state are presently each equally far spaced from the first leaf spring 56 such that the leaf springs 56, 58 are well distributed over the entire extension or length of the container 18. Preferably, at least the first leaf spring 56 and two further leaf springs 58 are provided. However, as exemplarily shown in FIG. 5, the first leaf spring 56 and four further leaf springs 58 can also be provided.

From FIG. 6 and from FIG. 7, it is apparent that the free ends 60, 62 of the respective leaf spring 56, 58 can be connected to the parts of the closure element 34 detachable from each other via ribbons 70 or the like. In FIG. 6, the airbag 14 is shown in its folded stowage position, in which the airbag 14 is received in the receiving space 50. According to FIG. 7, stretching the leaf springs 56, 58 advantageously ensures that the airbag 14 is output or transported out of the receiving space 50. The then exposed airbag 14 can particularly simply and fast be filled with ambient air by means of the blower 20.

Thus, the operation of triggering the airbag 14 can be divided into three partial steps. First, a tear point is opened or the closure element 34 is unlocked, then ejection of the airbag 14 from the receiving space 50 occurs by transferring the spring elements for instance in the form of the leaf springs 56, 58 into the stretched, relaxed state. Subsequently, the airbag 14 is deployed or inflated, namely with the aid of the electrically operated blower 20. Thus, the system is conceived such that the airbag 14 is securely transported out of the container 18 or the airbag pocket as a result of triggering such that it can be simply filled with air immediately thereafter.

In FIG. 8, it is well visible how the airbag 14 is output or transported out of the receiving space 50 and thus can be easily and fast inflated by means of the blower 20. In this free, deployed state, the airbag 14 can be very fast filled with a desired volume of ambient air, for example with a volume of about 150 liters, and the blower 20 does not have to apply a high pressure hereto. This is due to the fact that the airbag 14 is no longer in the container 18. Rather, the airbag 14 is already output.

In FIG. 9, the backpack 10 is shown with the U-shaped formed airbag pocket in a further perspective view. From this view, it is particularly well apparent how the zipper 64 is also kept closed or secured by means of the closure element 34, wherein the zipper 64 closes an outlet opening of the container 18 in the closed position of the container 18 or the airbag pocket. In addition, the actuating device 28 with the handle 30 and the pull rope 36 is also indicated in FIG. 9, which is coupled to the closure element 34 such that the closure element 34 can be unlocked or opened by pulling the handle 30.

In the variant of the backpack 10 shown in FIG. 10, the avalanche airbag system 12 again includes the airbag 14 and the electrical filling device 16 with the blower 20, which comprises the electric motor 22. In this respect, reference is made to the explanations to the already described variants of the backpack 10.

However, in this variant, the container 18 or the airbag pocket includes a spring element with two brackets 72, 74 (compare FIG. 11), which abut on each other if the container 18 is brought into the closed position (compare FIG. 10). In this state, the spring element is tensioned, which includes the two brackets 72, 74. Herein, a wall material 76 of the container 18 can be flexibly formed and for example be formed of a textile material and/or of a flexible, foil-like plastic material. This is because the brackets 72, 74 ensure a certain shaping of the container 18. The spring element is again kept in the tensioned state by means of the closure element 34 (compare FIG. 10).

If a pull is exerted on the closure element 34 by pulling the handle 30 of the actuating device 28 via the pull rope 36, thus, the closure element 34 is unlocked. Thereupon, the brackets 72, 74 move away from each other and the container 18 is brought into the open position shown in FIG. 11. Thus, the spring element with the two brackets 72, 74 is formed in the manner of a spring clip 78. In FIG. 11, the container is shown opened to a certain extent. However, if areas of the brackets 72, 74 abutting on each other in the closed position of the container 18 are maximally far moved away from each other and thus the container 18 is completely opened, thus, tensioning the wall material 76 formed as a flexible planar formation effects ejection of the airbag 14 from the receiving space 50. Herein, the brackets 72, 74 can in particular be brought into a stretched position. In particular, the planar formation can be provided by at least one textile material of fibers and/or by at least one foil-like polymer material.

In FIG. 11, the receiving space 50 of the container 18 is visible, but the airbag 14 output from the receiving space 50 is not illustrated for reasons of clarity. Furthermore, it is apparent from FIG. 11 that the two brackets 72, 74 bound an outlet opening of the container 18 if the container 18 is brought into the open position or opened, through which the airbag 14 set in the receiving space 50 is output or ejected from the receiving space 50.

What is claimed is:

1. A carrying device for an avalanche airbag system, comprising:

at least one airbag, a filling device for introducing at least one medium into the at least one airbag, at least one container having a closed position and an open position and including a receiving space for stowing the airbag, at least one closure element, and at least one spring element, wherein the at least one spring element is in a tensioned state when the container is in the closed position and is configured to bring the container from the closed position into the open position when the at least one closure element is opened, and wherein the at least one spring element is configured to transport the airbag out of the receiving space when the at least one container is in the open position, and an actuating device, wherein actuating the actuating device opens the at least one closure element, thereby bringing the at least one container into the open position, and causes the filling device to introduce the at least one medium into the at least one airbag.

2. The carrying device according to claim 1, wherein the at least one container includes a rigid base body and a rigid lid, wherein the at least one spring element is brought into the tensioned state when the rigid lid is closed.

3. The carrying device according to claim 2, wherein the at least one spring element is formed as a leg spring.

4. The carrying device according to claim 1, wherein the at least one spring element includes a first bracket and a second bracket, and wherein the first bracket and the second bracket bound an outlet opening of the container when the container is brought into the open position.

5. The carrying device according to claim 1, wherein the at least one spring element includes a relaxed state, a first free end, and a second free end, wherein the first free end and the second free end are spaced farther apart from each other in the relaxed state than in the tensioned state, and wherein the at least one spring element is curved in the tensioned state such that the at least one spring element at least partially encloses the receiving space.

6. The carrying device according to claim 5, wherein the at least one spring element comprises two or more spring elements arranged in the container and curved when in the tensioned state.

7. The carrying device according to claim 6, wherein the two or more spring elements comprise a first spring element and a second spring element, the first spring element curved in the tensioned state and retained in the tensioned state by the at least one closure element, and the second spring element retained in the tensioned state due to the closed position of the container.

8. The carrying device according to claim 7, wherein the two or more spring elements comprise a third spring element, and wherein the second spring element and the third spring element are substantially equally spaced from the first spring element.

9. The carrying device according to claim 1, wherein the at least one closure element includes a hook movable from an engagement position into a release position by actuating the actuating device.

10. The carrying device accordingto claim 9, wherein the at least one closure element includes a magnet.

11. The carrying device according to claim 1, wherein the airbag includes a wall material, and wherein the at least one spring element is affixed to the wall material of the airbag.

12. The carrying device according to claim 1, wherein when the container is in the closed position, the at least one closure element closes an outlet opening of the container.

13. The carrying device according to claim 1, wherein the filling device includes a blower with an electric motor and at least one electrical energy storage for supplying the electric motor with electrical energy.

14. The carrying device according to claim 13, wherein the blower comprises an axial compressor.

15. The carrying device according to claim 13, wherein the actuating device includes a handle, and wherein starting the electric motor can be effected by pulling the handle.

16. The carrying device according to claim 14, wherein the actuating device includes a handle, and wherein starting the electric motor can be effected by pulling the handle.

17. The carrying device according to claim 1, wherein the at least one closure element includes a magnet.

18. A carrying device for an avalanche airbag system, comprising:

at least one airbag comprising a wall material, a filling device for introducing at least one medium into the at least one airbag, at least one container for stowing the at least one airbag, the at least one container including at least one closure element and having a closed position and an open position, at least one spring element affixed to the wall material of the airbag, wherein the at least one spring element is in a tensioned state when the container is in the closed position and is configured to bring the container from the closed position into the open position when the at least one closure element is opened, and an actuating device, wherein actuating the actuating device opens the at least one closure element, thereby bringing the at least one container into the open position, and causes the filling device to introduce the at least one medium into the at least one airbag.

19. The carrying device according to claim 18, wherein the container has a receiving space for receiving the airbag, and wherein the at least one spring element is configured to transport the airbag out of the receiving space.

20. The carrying device according to claim 19, wherein the at least one spring element includes a relaxed state, a first free end, and a second free end, wherein the first free end and the second free end are spaced farther apart from each other in the relaxed state than in the tensioned state, and wherein the at least one spring element is curved in the tensioned state such that the at least one spring element at least partially encloses the receiving space.

* * * * *